US005471719A

United States Patent [19]

Sawyers

[11] Patent Number: 5,471,719

[45] Date of Patent: Dec. 5, 1995

[54] AIR GUN PELLET FORMING METHOD

[76] Inventor: William L. Sawyers, 269 Sinai Dr., Pacheco, Calif. 94553

[21] Appl. No.: 58,136

[22] Filed: May 10, 1993

[51] Int. Cl.[6] ..... B21K 21/06

[52] U.S. Cl. ..... 29/1.2; 29/1.22; 29/558; 102/508; 102/509

[58] Field of Search ..... 29/1.2, 1.21, 1.22, 29/1.23, 401.1, 557, 558; 102/501, 507–510, 502, 503, 517, 521, 529; 273/428

[56] References Cited

U.S. PATENT DOCUMENTS

| | | | |
|---|---|---|---|
| 517,560 | 4/1894 | Ashley | 29/1.2 X |
| 1,447,478 | 3/1923 | Koshollek et al. | 29/1.22 X |
| 4,005,660 | 2/1977 | Pichard | 102/506 |
| 4,251,079 | 2/1981 | Earl et al. | 273/428 |
| 4,383,853 | 5/1983 | Zapffe | 75/122.7 |
| 4,610,061 | 9/1986 | Halverson | 29/1.23 |
| 4,945,836 | 8/1990 | Michaels | 102/503 |
| 5,131,123 | 7/1992 | Brooks | 29/1.2 |

*Primary Examiner*—S. Thomas Hughes

[57] ABSTRACT

An air gun pellet is formed to include providing a pellet member having a conical skirt, to include a pellet head along a pellet axis, with a skirt cavity directed into the skirt and a head cavity directed into the head coaxially aligned along the axis, wherein the skirt is arranged for filling with a solder insert, whereupon subsequently, a bore member is directed coaxially through the pellet member coextensively thereof.

3 Claims, 4 Drawing Sheets

AIR GUN PELLET FORMING METHOD

BACKGROUND OF THE INVENTION

1. Field of the Invention

The field of invention relates to pellet construction, and more particularly pertains to a new and improved air gun pellet forming method arranged to effect improved impact characteristics relative to an air gun pellet member.

2. Description of the Prior Art

Pellet members typically formed of lead or lead alloy or a substitute therefore such as indicated in U.S. Pat. No. 4,383,853 incorporated herein by reference are available in the prior art. Such pellet members are arranged for enhanced impact and mushrooming during various targeting and hunting procedures.

The instant invention attempts to overcome deficiencies of the prior art by providing for a pellet forming method wherein the same is directed to the forming method having a through directed bore to enhance mushrooming and deformation of the pellet upon impact with a target object.

SUMMARY OF THE INVENTION

In view of the foregoing disadvantages inherent in the known types of air gun pellet members now present in the prior art, the present invention provides an air gun pellet forming method wherein the same is arranged to provide for a solid pellet having a through directing bore extending coextensively thereof coaxially aligned relative to the pellet member. As such, the general purpose of the present invention, which will be described subsequently in greater detail, is to provide a new and improved air gun pellet forming method which has all the advantages of the prior art air gun pellet forming methods and none of the disadvantages.

To attain this, the present invention provides an air gun pellet formed to include providing a pellet member having a conical skirt, to include a pellet head along a pellet axis, with a skirt cavity directed into the skirt and a head cavity directed into the head coaxially aligned along the axis, wherein the skirt is arranged for filling with a solder insert, whereupon subsequently, a bore member is directed coaxially through the pellet member coextensively thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air gun pellet forming method which has all the advantages of the prior art air gun pellet forming methods and none of the disadvantages.

It is another object of the present invention to provide a new and improved air gun pellet forming method which may be easily and efficiently manufactured and marketed.

It is a further object of the present invention to provide a new and improved air gun pellet forming method which is of a durable and reliable construction.

An even further object of the present invention is to provide a new and improved air gun pellet forming method which is susceptible of a low cost of manufacture with regard to both materials and labor, and which accordingly is then susceptible of low prices of sale to the consuming public, thereby making such air gun pellet forming methods economically available to the buying public.

Still yet another object of the present invention is to provide a new and improved air gun pellet forming method which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
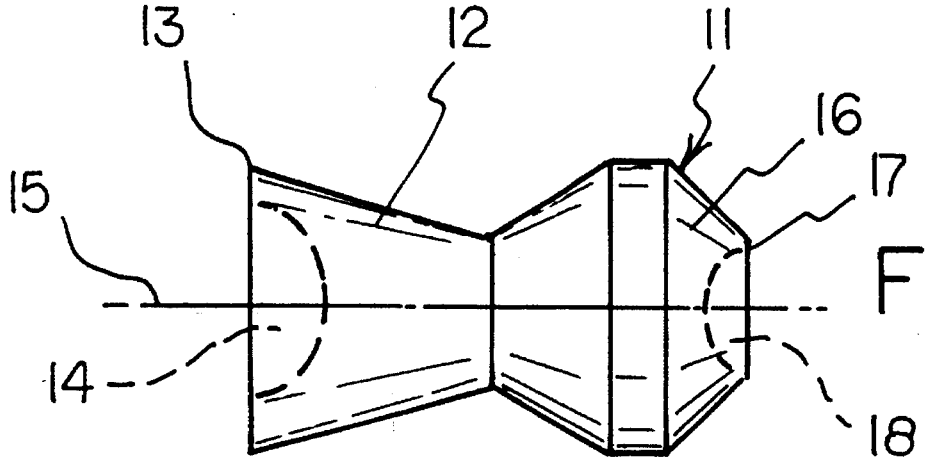
FIG. 1 is an orthographic view of a pellet member preparatory to additional modification thereof.
Figure 2:
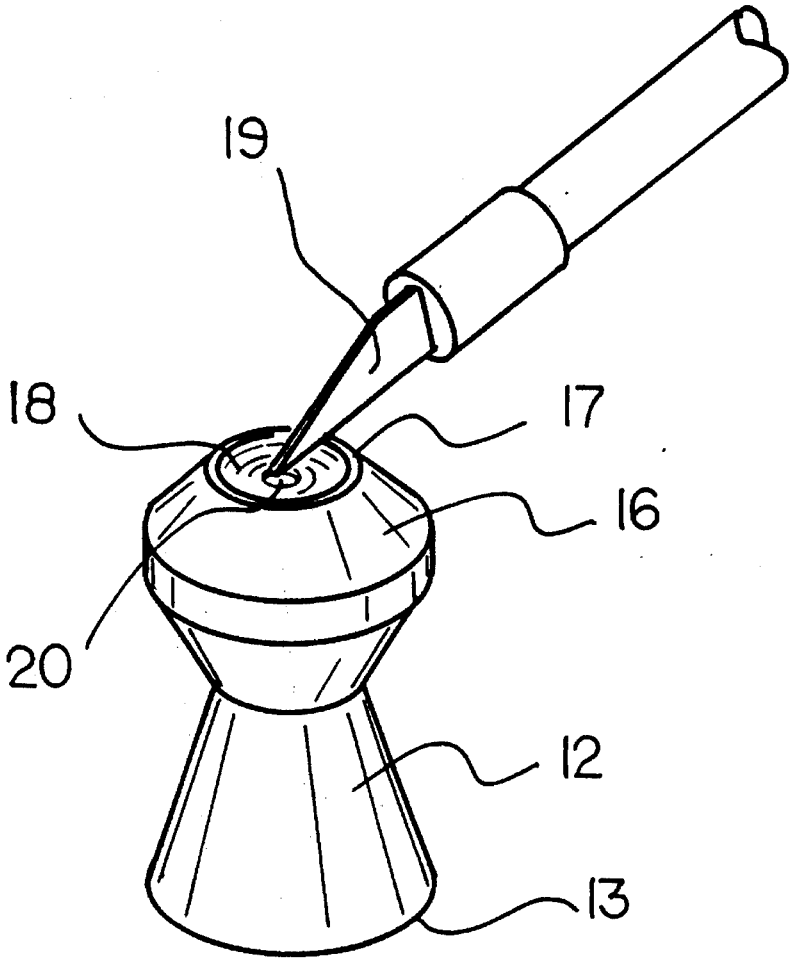
FIG. 2 is an isometric illustration indicating marking of an indentation within the pellet head.
Figure 3:
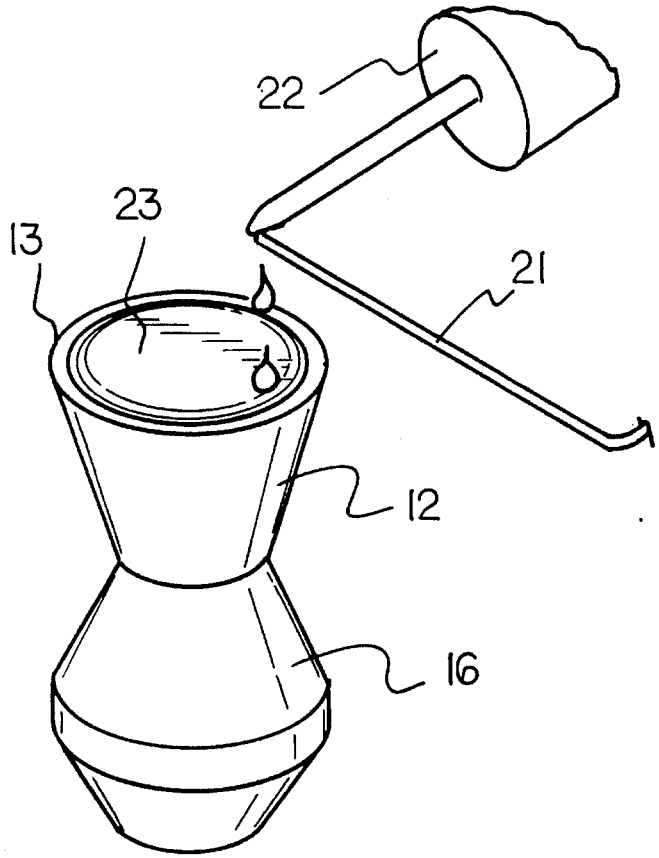
FIG. 3 is an isometric illustration of filling the skirt cavity with a fluid metallic material.
Figure 4:
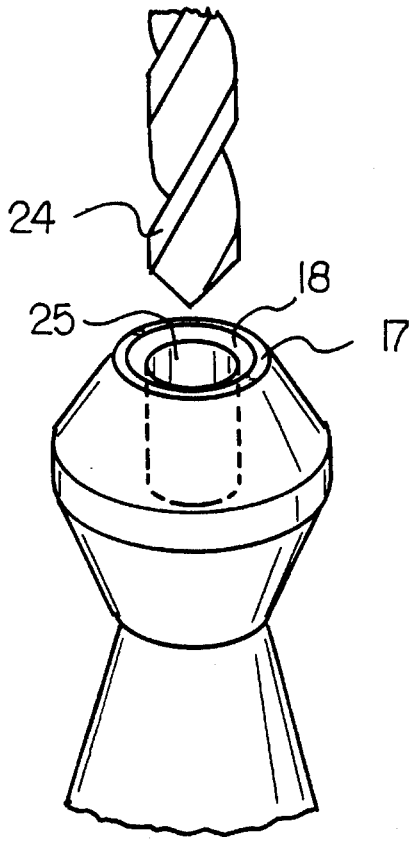
FIG. 4 is an isometric illustration of an initial pilot hole.
Figure 5:
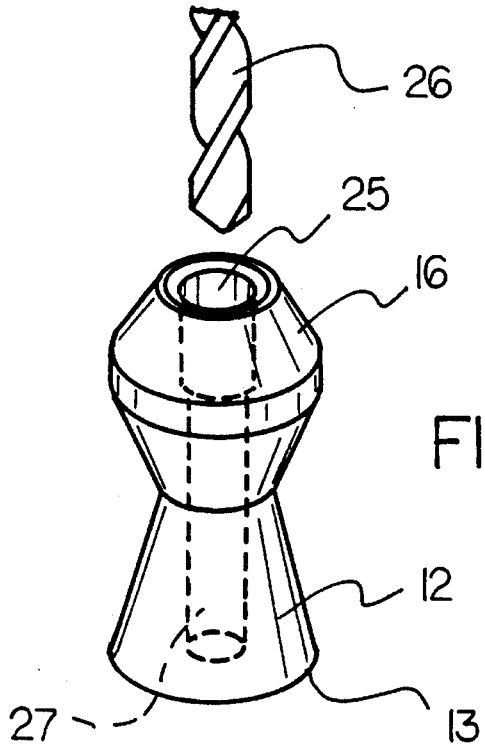
FIG. 5 is an isometric illustration of directing a through-extending bore extending from the pilot hole coextensively of the pellet member.
Figure 6:
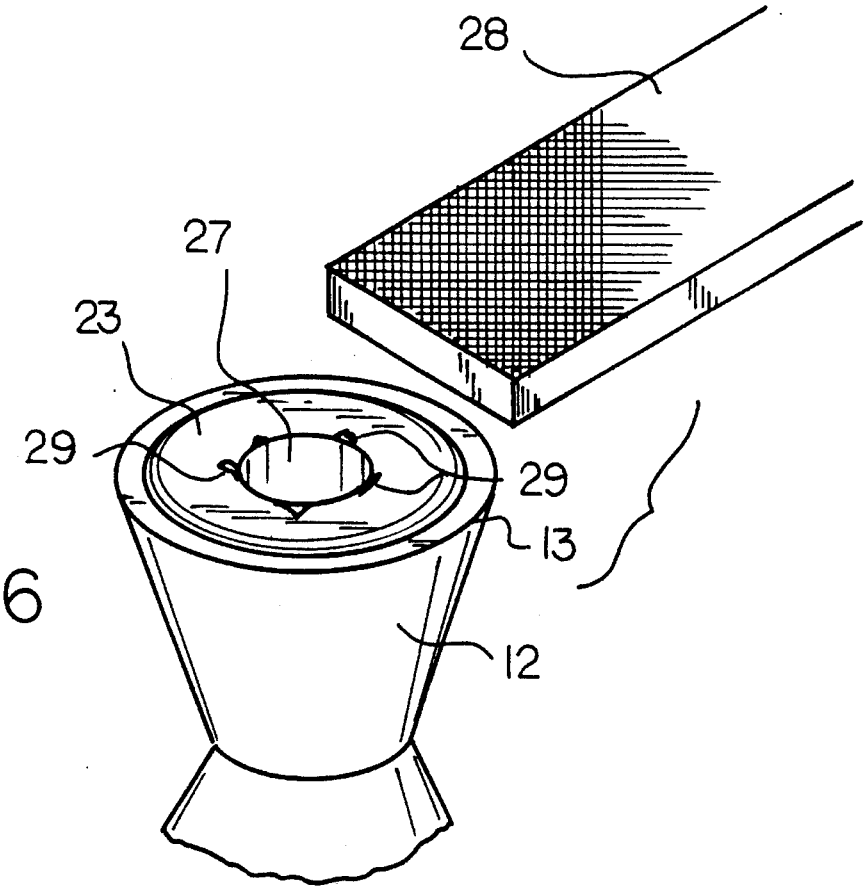
FIG. 6 is an isometric illustration of the boring of the pellet member subsequent to forming of the through-extending bore.
Figure 7:
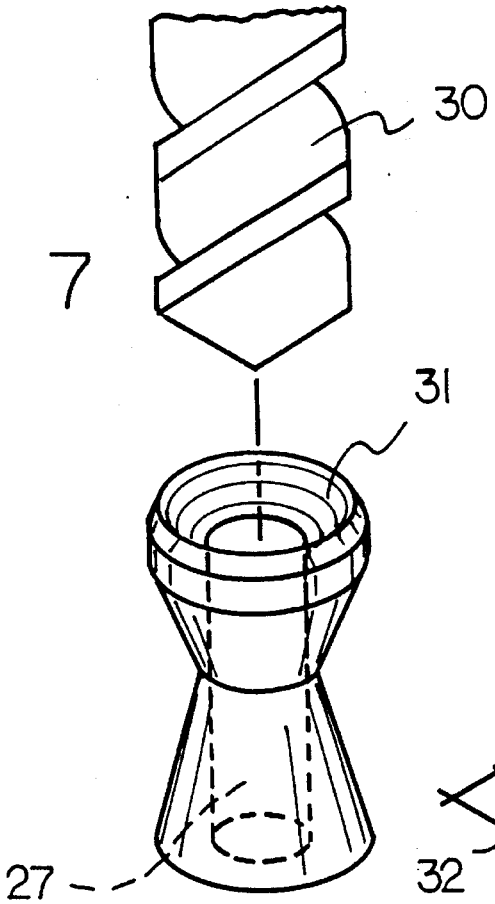
FIG. 7 is an isometric illustration of a further modification of the pellet member forming a conical pocket.
Figure 8:
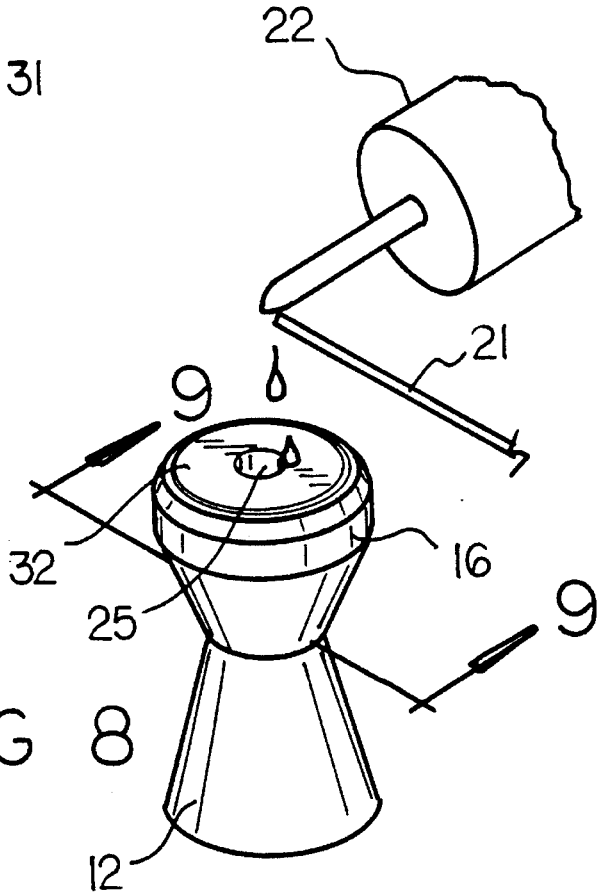
FIG. 8 is an isometric illustration of filling the conical pocket.

With reference now to the drawings, and in particular to FIGS. 1 to 9 thereof, a new and improved air gun pellet forming method embodying the principles and concepts of the present invention and generally designated by the reference numerals 11–36 will be described.

More specifically, the air gun pellet forming method of the instant invention essentially comprises the provision of a pellet member 11 having a truncated conical skirt 12, including a pellet head 16 mounted to the truncated conical skirt integrally along the pellet axis 15. The skirt 12 includes a free annular edge 13 having a skirt cavity 14 directed into the skirt from the free annular edge 13, with the pellet head including a pellet head forward wall 17 orthogonally oriented to the axis 15, having a pellet head cavity 18 directed into the forward wall 17 symmetrically about the axis 15.

A cutting tool, such as a knife member 19, is directed into the head cavity 18 concentric with the axis 15 providing orientation and positioning of a first drill 24 directed coaxially along the axis 15 into the pellet head 16 extending from the indentation 20. Typically, a one-eighth inch hole in depth is drilled utilizing a seven-sixty-fourths inch drill that provides a seven-sixty-fourths inch diameter hole of one-eighth inch in depth. A solder rod 21 is provided, wherein a solder gun member 22 flows the solder into the skirt cavity 14 providing for a solder insert 23 filling in the skirt cavity 14 in a coplanar orientation relative to the conical skirt free annular edge 13 that is orthogonally oriented relative to the axis 15. A second drill 26 is provided (see FIG. 5) of a second diameter less than the first diameter of the first drill 24, wherein the second drill 26 directs the second bore hole 27 coaxially aligned along the axis 15 coextensive of the pellet member 11. Typically, the second bore hole is of a three-thirty-seconds inch diameter. An abrading tool 28 such as a file member is provided to eliminate the burrs 29 projecting from the second bore hole 27 extending from the solder insert 23. Improved mushrooming and trajectory of the resultant pellet structure is thusly effected.

Figure 9:
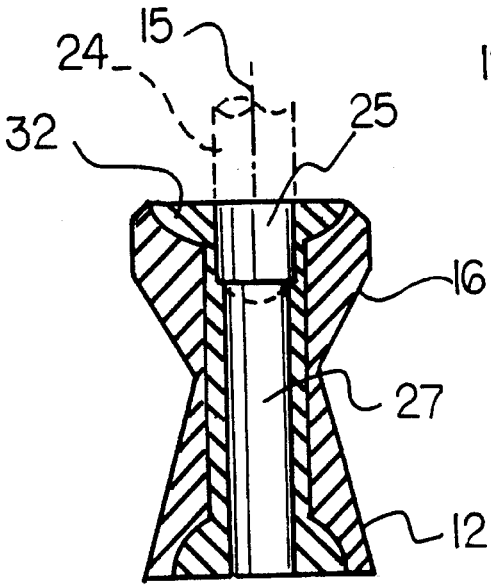
FIG. 9 is an orthographic view, taken along the lines 9—9 of FIG. 8 in the direction indicated by the arrows.

Additionally should one desire, a third drill 30 having a third diameter greater than the second diameter and the first diameter with the first and second drills 24 and 26 respectively is provided, wherein the third drill is directed along the axis 15 drilling a cavity 31 into the pellet head 16 about the first bore hole 15 eliminating the pellet head forward wall 17 that had been constructed in an orthogonal orientation relative to the axis 15. The first drill 24 is inserted within the first bore hole 25, as illustrated in phantom in FIG. 9, whereupon a second solder insert 32 is flowed into the conical cavity 31, whereupon removal of the first drill 25 maintains the through-extending bore structure as indicated in FIG. 9.

It should be understood that liquid solder of any desirable type may be employed and typically solder of a sixty-forty tin/lead composition may be employed.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air gun pellet forming method, comprising, providing a pellet member, wherein the pellet member includes a truncated conical skirt having a free annular edge, and the pellet member further including a pellet head fixedly mounted to the conical skirt spaced from the annular edge coaxially aligned along a pellet axis, wherein the pellet head includes a pellet head forward wall, wherein the forward wall and the annular edge are arranged parallel relative to one another and orthogonally oriented relative to the pellet axis, and a pellet head cavity is directed into the pellet head from the forward wall, and a skirt cavity is directed into the conical skirt from the free annular edge, and including the step of providing a first drill having a first diameter and forming by use of the first drill, a first bore hole coaxially aligned along the pellet axis directed into the pellet head cavity, and the step of providing a second drill, wherein the second drill is defined by a second diameter, the first drill having a first diameter, the second diameter being less than the first diameter, and the second drill is directed coaxially along the axis extending from the first bore hole coextensively through the pellet member projecting to the annular edge medially thereof to form a second bore hole, and the step of filling the conical skirt cavity with a flowable material and subsequently permitting said flowable material to solidify within the skirt cavity prior to directing the second bore hole coextensively through the pellet member, and the step of providing an abrading tool and directing the abrading tool over the second bore hole providing an uninterrupted smooth planar surface along the insert simultaneously removing burrs formed during formation of the second bore hole, and the step of providing the flowable material includes employing a solder rod and melting the solder rod with a solder gun member and directing the flowable material into the skirt cavity.

2. A method as set forth in claim 1 including the step of providing an indentation into the pellet head cavity coaxially aligned along the axis prior to directing the first bore hole into the pellet head cavity by the first drill.

3. A method as set forth in claim 2 including the step of providing a third drill having a third diameter greater than said first diameter and greater than said second diameter, wherein the third drill is directed into the pellet head forward wall coaxially aligned along the axis thereby eliminating the forward wall and forming a conical cavity and subsequently positioning the first drill within the first bore hole and filling said conical cavity with a further metallic insert.

* * * * *